US007461640B1

(12) United States Patent
Agee et al.

(10) Patent No.: US 7,461,640 B1
(45) Date of Patent: Dec. 9, 2008

(54) COOLING SYSTEM WITH BOILING PREVENTION

(75) Inventors: Keith Agee, Torrance, CA (US); Richard P. Beldam, Torrance, CA (US); William L. Klein, Lakewood, CA (US)

(73) Assignee: Honeywell International, Inc., Morristown, NJ (US)

( * ) Notice: Subject to any disclaimer, the term of this patent is extended or adjusted under 35 U.S.C. 154(b) by 0 days.

(21) Appl. No.: 11/858,293

(22) Filed: Sep. 20, 2007

(51) Int. Cl.
*F02B 47/08* (2006.01)
*F02M 25/07* (2006.01)

(52) U.S. Cl. ..... 123/568.12; 123/568.13; 123/568.14; 123/568.15; 123/568.16; 123/568.17

(58) Field of Classification Search ..... 123/568.12–568.18, 569; 60/599–604, 605.2, 60/608–612; 165/164
See application file for complete search history.

(56) References Cited

U.S. PATENT DOCUMENTS 5,732,688 A * 3/1998 Charlton et al. ..... 123/568.12
6,367,256 B1 * 4/2002 McKee ..... 60/605.2
7,363,919 B1 * 4/2008 Styles ..... 123/568.12
2006/0185364 A1 * 8/2006 Chalgren et al. ..... 60/599

* cited by examiner

*Primary Examiner*—Stephen K Cronin
*Assistant Examiner*—Keith Coleman

(57) ABSTRACT

A cooling system comprises a cooler with a hot-side passage extending between hot-side inlet and outlets. The cooler further includes a cooling passage extending between cold-side inlet and outlets. A cooling medium is disposed within the cooling passage, and is in contact with the hot-side passage to reduce the temperature of the gas or liquid passing through the hot-side passage. The cooling system is configured to regulate the condition of the cooling medium within the cooler to reduce/eliminate unwanted boiling of the cooling medium being within the cooler. The cooling system can include controller that provides an output signal in response to a detected condition of the cooling medium, and a device that receives the output signal and changes the operation of the cooling system and/or operation of an internal combustion engine to reduce the occurrence of unwanted cooling medium boiling within the cooler.

19 Claims, 6 Drawing Sheets

COOLING SYSTEM WITH BOILING PREVENTION

FIELD OF THE INVENTION

This invention relates generally to the field of gasoline and diesel-powered internal combustion engines that use a heat exchanger or cooler to reduce the temperature of an incoming liquid or gas stream and, more particularly, to an exhaust gas recirculation (EGR) system comprising a cooler for emissions improvement and to devices and/or methods for controlling the same for reducing and/or preventing unwanted boiling of a cooling medium used within the system.

BACKGROUND OF THE INVENTION

EGR is a known method for reducing NOx emissions in internal combustion engines. Conventional EGR systems work by taking a by-pass stream of engine exhaust gas from an engine exhaust manifold and directing the same to an EGR valve. The EGR valve is designed and operated to provide a desired amount of exhaust gas to mix with an intake air stream and inject the mixture into the engine's induction system for subsequent combustion. The EGR valve is operated to regulate the amount of exhaust gas that is routed to the engine induction system based on engine demand.

The purpose of recirculating exhaust gas is to reduce the oxygen content of the air in the cylinder. With less oxygen to react with the nitrogen, less NOx is formed. It also lowers the temperature by absorbing some of the heat of combustion. Accordingly, such a conventional EGR system typically comprises exhaust by-pass tubing, related plumbing and manifolding, and an EGR control valve, all of which are ancillary components that are attached to the engine and/or to the area surrounding the engine.

In certain applications, is it desired that the exhaust gas exiting the EGR system and being introduced into the engine intake system for combustion be cooled for the purposes of reducing emissions, specifically NOx. Cooling the exhaust gas reduces NOx because less NOx is formed at lower temperatures. Cooler gas is also more dense so more recirculated gas can be packed into the cylinder. Accordingly, it is known that a cooler is used in certain EGR systems for the purpose of cooling or reducing the temperature of the exhaust gas that is passed through the EGR valve to the engine intake system. Typically, the EGR cooler is placed downstream from the EGR valve outlet such that all exhaust gas exiting the valve for directing to the engine intake is routed through the cooler. Such EGR coolers can be air or water cooled, and can be configured having single or multiple passes, as required for the particular application.

An issue that is known to exist with such conventional EGR systems comprising a cooler is that, under certain operating conditions, the temperature within the cooler can cause the cooling medium (typically in liquid form) that passes therethrough to reach its bubble point and boil. When the cooling medium first reaches the boiling point, nucleate boiling is induced, where very small bubbles form and collapse. This is a beneficial phenomenon and actually improves the heat transfer. However, only a small increase in heat load (or a reduction in coolant pressure) can shift the boiling mode to transition boiling, which is an unstable mode that can lead to large bubbles that leave vapor on the heat transfer surface. This phase change from liquid to vapor causes two undesired events to occur. First, the cooling medium no longer performs its cooling function, thus fails to reduce the temperature of the hot-side liquid or gas being passed through the cooler. Second, the phase change from liquid to vapor that occurs at the during transition boiling causes the pressure within the cold-side of the cooler to increase, thereby operating to potentially damage the cooler itself and/or other devices that are connected to the cooler.

It is, therefore, desired that a cooling system as used with internal combustion engines, e.g., as used within an EGR cooling system, be configured and/or operated in a manner that can help reduce the occurrence of cooling medium boiling, which may occur during infrequent episodes of high gas temperatures or during situations where the coolant temperature may increase due to high ambient temperature conditions, thereby increasing the effective service life of such cooling system. It is desired that such cooling system and/or method for controlling the same be relatively easy to implement and not take up excessive space in the engine compartment. It is further desired that such cooling system be configured in a manner capable of being incorporated into an engine EGR system an engine without unnecessary complexity.

SUMMARY OF THE INVENTION

Cooling systems constructed according to principles of the invention comprise a cooler that includes a hot-side inlet, a hot-side outlet, and one or more hot-side passages extending between the hot-side inlet and outlets. The cooler further includes a cold-side inlet and a cold-side outlet, and one or more cooling passages extending between the cold-side inlet and outlets. A cooling medium is disposed within the one or more cooling passages, and is in contact with the hot-side passage to reduce the temperature of the gas or liquid passing through the one or more hot-side passages.

The cooling system includes means for regulating the condition of the cooling medium within the cooler to reduce the occurrence of the cooling medium being in an unwanted boiling state within the cooler. The means can include a controller that is configured to provide an output signal in response to a detected condition of the cooling medium, and a device that receives the output signal and changes the operation of the cooling system to reduce the occurrence of unwanted cooling medium boiling within the cooler.

In one example embodiment, the means for regulating can be a bypass valve that is positioned upstream of the cooler, and that is operated by the controller to adjust the amount of gas or liquid directed to the cooler. In another example embodiment, the means for regulating can be a vane that is movably disposed within the cooler and that is positioned to change the flow direction of cooling medium within the cooler. In still another example embodiment, the means for regulating can be an auxiliary cold-side inlet connected to the cooler to cause an additional volume of cooling medium to enter and mix with the cooling medium already disposed in the cooler.

The cooling system device can be configured to adjust one or more operating modes of an internal combustion engine to reduce unwanted boiling of the cooling medium. The cooling system can include a pressure sensor that detects the condition of the cooling medium, and that provides an input signal to the controller, wherein the controller is designed to determine whether the pressure corresponds with the cooling medium being in a unwanted boiling state.

Cooling systems constructed in this matter reduce or eliminate the unwanted boiling of the cooling medium with the cooler during operation, thereby increasing the effective service life and performance efficiency of such cooling systems.

DESCRIPTION OF THE DRAWINGS

The details and features of the present invention will be more clearly understood with respect to the detailed description and drawings wherein.

DETAILED DESCRIPTION OF THE INVENTION

Cooling systems of this invention are designed to include a bypass valve positioned upstream from the hot-side gas or liquid entering a cooler. The bypass valve is controlled to regulate the flow of the hot-side gas or liquid to the cooler to minimize and/or prevent the cooling medium used within the cooler from reaching its bubble point or boiling, thereby operating to maintain a desired degree of heat transfer within the cooler and further operating to reduce the presence of unwanted pressure within the cooler associated with any boiling of the cooling medium.

Cooling systems of this invention can be used in conjunction with a number of different applications where a desired exchange of temperature between two or more liquids and/or gases passing through a heat exchanger or cooler is desired. When used in conjunction with internal combustion gasoline or diesel-powered engines, such cooling systems can be used, e.g., with EGR systems to cool the flow of exhaust gas to the engine, or with turbocharger systems to cool the charge air directed to the engine. Generally speaking, the cooling system of this invention makes use of the bypass valve in association with a controller for the purpose of regulating the passage of hot-side gas or liquid through the cooler so as to minimize or prevent the unwanted boiling of the cooling medium being passed therethrough.

Figure 1:
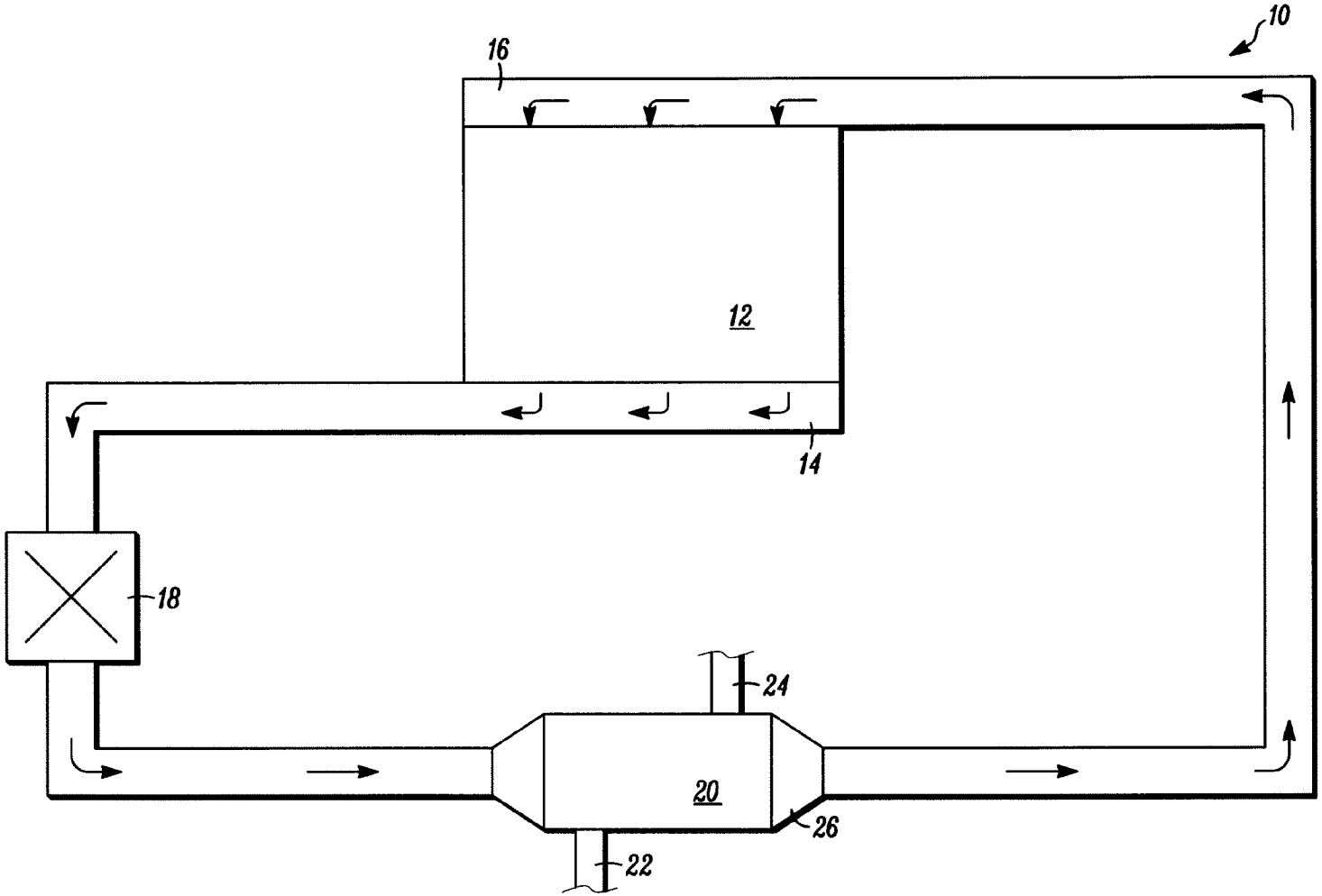
FIG. 1 is schematic view of a conventional exhaust gas recirculation (EGR) system.

FIG. 1 schematically illustrates a prior art EGR system 10 comprising an internal combustion engine 12, which can be either gasoline or diesel powered. The engine 12 includes an exhaust system manifold 14 attached thereto downstream of the engine's internal combustion chambers for removing exhaust gas from the engine, an intake system manifold 16 attached thereto upstream of the engine's internal combustion chambers for directing a desired combustion mixture to engine. The engine can also include a turbocharger, not shown, driven by the exhaust gas exiting the engine via the exhaust manifold, and used to pressurize the combustion mixture entering the engine via the intake manifold. The engine can also include supercharger that is driven by the engine crankshaft to deliver pressurized air via the intake manifold to the engine for combustion.

An EGR control valve 18 is connected downstream of the exhaust manifold 14 to receive an exhaust gas stream from the engine. The EGR control valve 18 is configured to regulate a desired amount of exhaust gas flow for subsequent reintroduction into the engine intake system for combustion. The EGR valve 18 is connected to an EGR cooler 20 that receives exhaust gas exiting the EGR valve for passage therethrough for cooling the exhaust gas prior to reintroduction. While the EGR valve in this prior art system has been illustrated as being position upstream from the cooler 20, EGR valves in such conventional EGR systems can alternatively be positioned downstream from the cooler 20.

The EGR cooler 20 can be of a single or multi-pass configuration (depending on the particular application) so that exhaust gas entering the cooler from the EGR valve 18 passes through the cooler once or a number of times. The cooler includes a cooling medium inlet 22 and a cooling medium outlet 24 to facilitate passage of a desired cooling medium through the cooler. In an example embodiment, the exhaust gas passes through a number of passages running through the cooler, and the cooling medium is passed over the surface of the passages to effect the desired cooling of the exhaust gas passing therethrough. The cooled exhaust gas exits the cooler 20 via an outlet 26 that is coupled via a suitable piping and/or connectors to the engine intake system 16 for mixing with intake air and routing to the engine combustion chamber.

Figure 2:
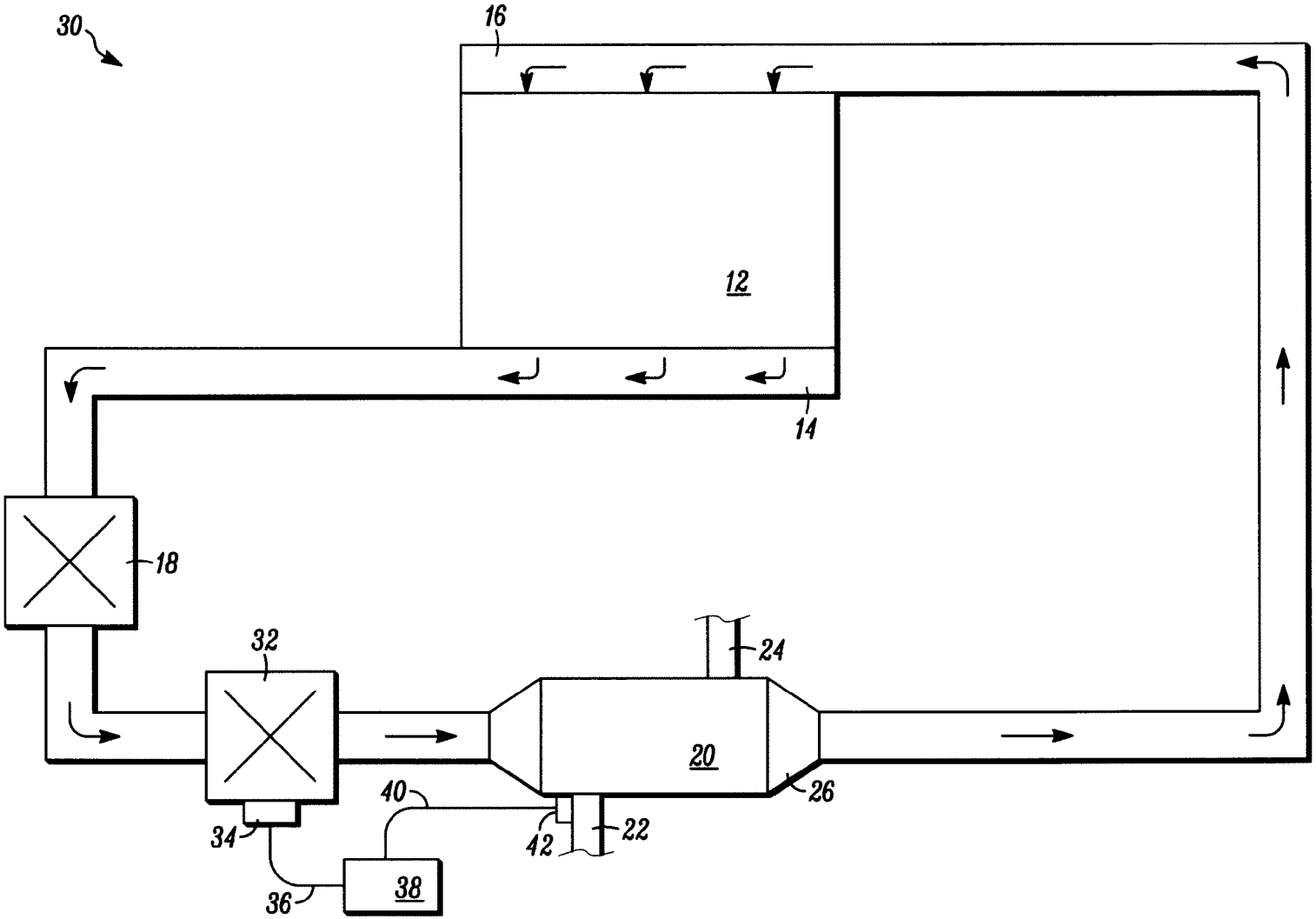
FIG. 2 is a schematic view of a first embodiment cooling system of this invention as used in an EGR system.

FIG. 2 illustrates a first embodiment cooling system 30 of this invention as used in conjunction with an EGR system as described above. The cooling system comprises a bypass valve 32 that is positioned upstream from the cooler 20 within the exhaust gas flow path to regulate the passage of exhaust gas that is directed to the cooler 20. The bypass valve 32 can be of conventional design, e.g., can be a butterfly valve, a poppet valve, and the like, and is configured to bypass the exhaust gas that is directed thereto away from the cooler under certain operating conditions. While the bypass valve 32 is illustrated in FIG. 2 as being independent from the cooler, it is to be understood that the bypass valve can be constructed as part of the cooler, e.g., as an internal or external part of the cooler adjacent an exhaust gas inlet.

Additionally, while the bypass valve 32 has been positioned within the cooling system of FIG. 2 downstream of the EGR valve 18, it is to be understood that the bypass valve can alternatively be positioned upstream from the EGR valve 18. A key feature of the bypass valve is that it be positioned within the stream of the entering gas or liquid to be cooled upstream of the cooler.

The bypass valve 32 is configured having an actuator 34 that operates the valve based on a control signal 36. The bypass valve can be actuated by electric, pneumatic, hydraulic or mechanical means. In an example embodiment, the control signal 36 for operating the bypass valve is generated by a controller 38 that is configured to receive one or more input signals 40 from one or more sensors 42 and provide a desired control signal 36 based on the one or more input signals. In an example embodiment, the controller 38 can be separate from an engine control unit (ECU), while in another embodiment the bypass valve controller can exist as a feature of an ECU.

The sensor or sensors that are used to generate a desired input signal to the controller are ones that are positioned on elements of the engine or the EGR system capable of detecting predetermined changes in the cooling medium. In an example embodiment, a pressure sensor can be used and positioned as needed to monitor the pressure of the cooling medium being used by the cooler. The controller is programmed or otherwise configured to send a control signal to actuate the bypass valve in the event that an input signal received from the pressure sensor indicates that the cooling medium in a boiling state, e.g., is at its bubble point or boiling temperature.

The extent that the controller actuates the bypass valve and/or the time that the valve is actuated will vary depending on the detected cooling medium pressure. In an example embodiment, the controller actuates the valve to an extent and/or for duration sufficient to temporarily reduce the exhaust gas flow, and thus the heat load, to the cooler. This reduced exhaust gas flow operates to reduce the thermal peak within the cooler, thereby enabling the temperature of the cooling medium to be reduced below its bubble point to facilitate desired operation of the cooler. In an example embodiment, when the pressure sensor senses a variation in cooling medium pressure, such variation being associated with boiling regardless of whether such boiling is caused by excessive inlet gas or liquid temperature, excessive cooling temperature, or too low cooling medium pressure, the controller is designed to operate the bypass valve for a short period of time, e.g., 5 minutes, until the temporary thermal peak has passed.

While the use of cooling medium pressure has been described as one indicator that can be monitored by sensors or the like, it is to be understood that other indicators can be monitored separately or in conjunction with the cooling medium pressure for purpose of controlling the cooling system in the manner described. For example, the temperature of the hot-side gas or liquid exiting the cooler can be monitored, as sharp increases in the temperature of the exiting gas or liquid oftentimes provides an indication that the cooling medium has reached its bubble point or boiling temperature. Additionally, the cooling medium temperature as a function of the cooling medium pressure can be monitored to define when the coolant medium saturation temperature has been reached or exceeded.

The bypass valve and/or the controller can be configured to permit a fine level of flow control so as to permit a precise control of the cooling medium conditions within the cooler. For example, the bypass valve can be configured to be controlled in a manner enabling the cooling medium within the cooler to exist at a nucleate boiling mode, i.e., where only small bubbles begin to form and that typically compress under pressure and that do not appreciably reduce the cooling effect of the cooling medium. Operating in the nucleate boiling mode is beneficial because it facilitates maximum use of the cooling medium being passed through the cooler. Accordingly, by controlling the exhaust gas flow to avoid the more serious transition boiling mode, i.e., where large bubbles are formed that do not compress, that reduce the desired contact of the liquid phase cooling medium with the exhaust gas passages in the cooler, and that vastly increases the pressure within the cooler, the performance of the cooler can actually be increased by harnessing phase change heat transfer.

Figure 3:
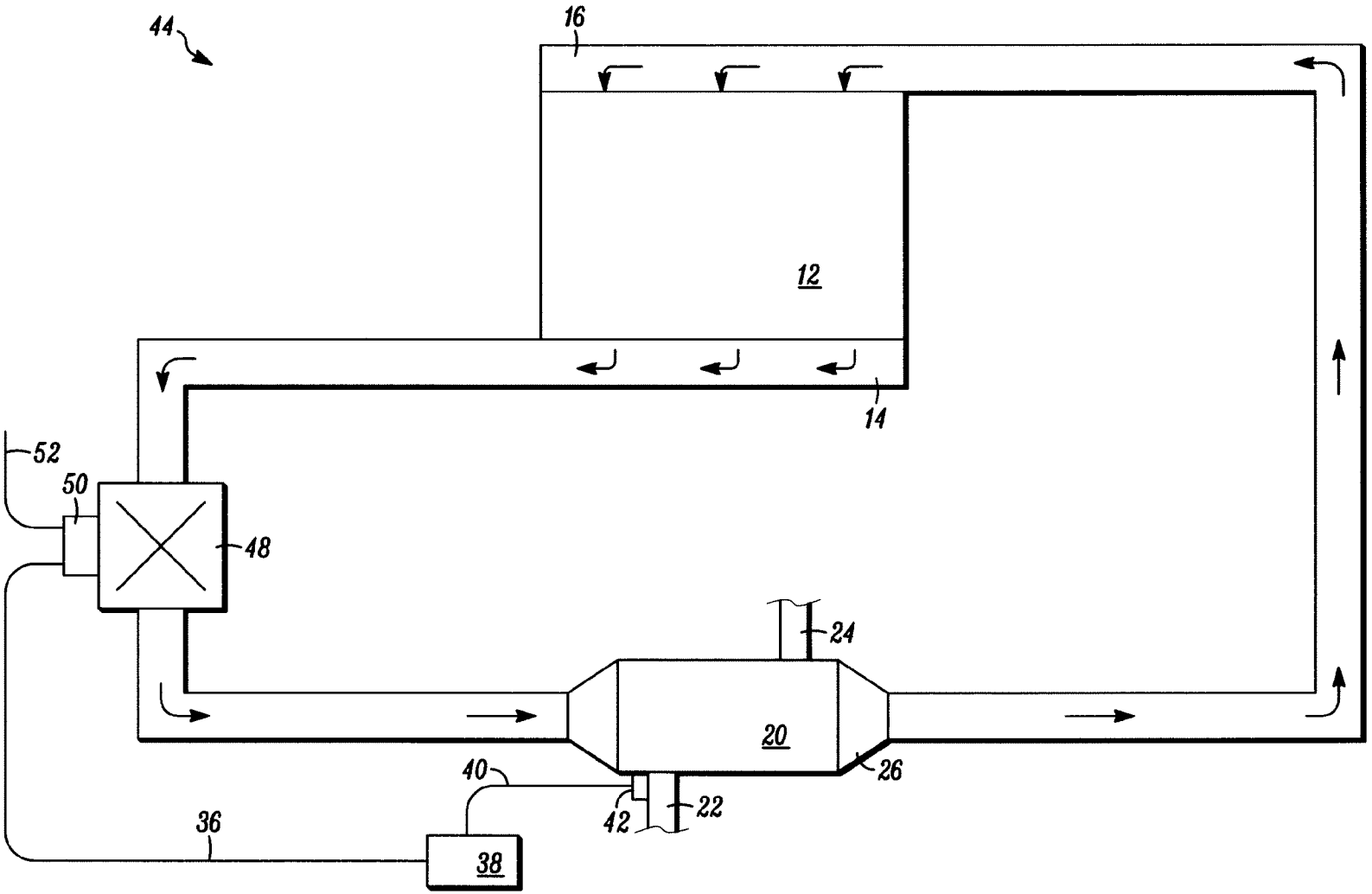
FIG. 3 is a schematic view of a second embodiment cooling system of this invention as used in an EGR system.

FIG. 3 illustrates a second embodiment of the cooling system 44 of this invention. The second embodiment is somewhat similar to that of the first embodiment illustrated in FIG. 2, except that when used in an EGR system, this second embodiment makes use of a single valve 48 that is configured to function as both the EGR valve and the bypass valve. In this particular embodiment, the valve 48 is disposed upstream of the cooler 20 within the exhaust gas inlet stream, and is configured having an actuator 50 that receives a control signal 52 as a conventional EGR valve and to receive control signals 36 regulating the extent of exhaust gas flow to the cooler based on the conditions of the cooling medium within the cooler, i.e., whether it is in a boiling state or mode. As noted above for the first cooling system embodiment, the valve 48 can be separate from the cooler 20 or can be configured to be part of the cooler.

Figure 4:
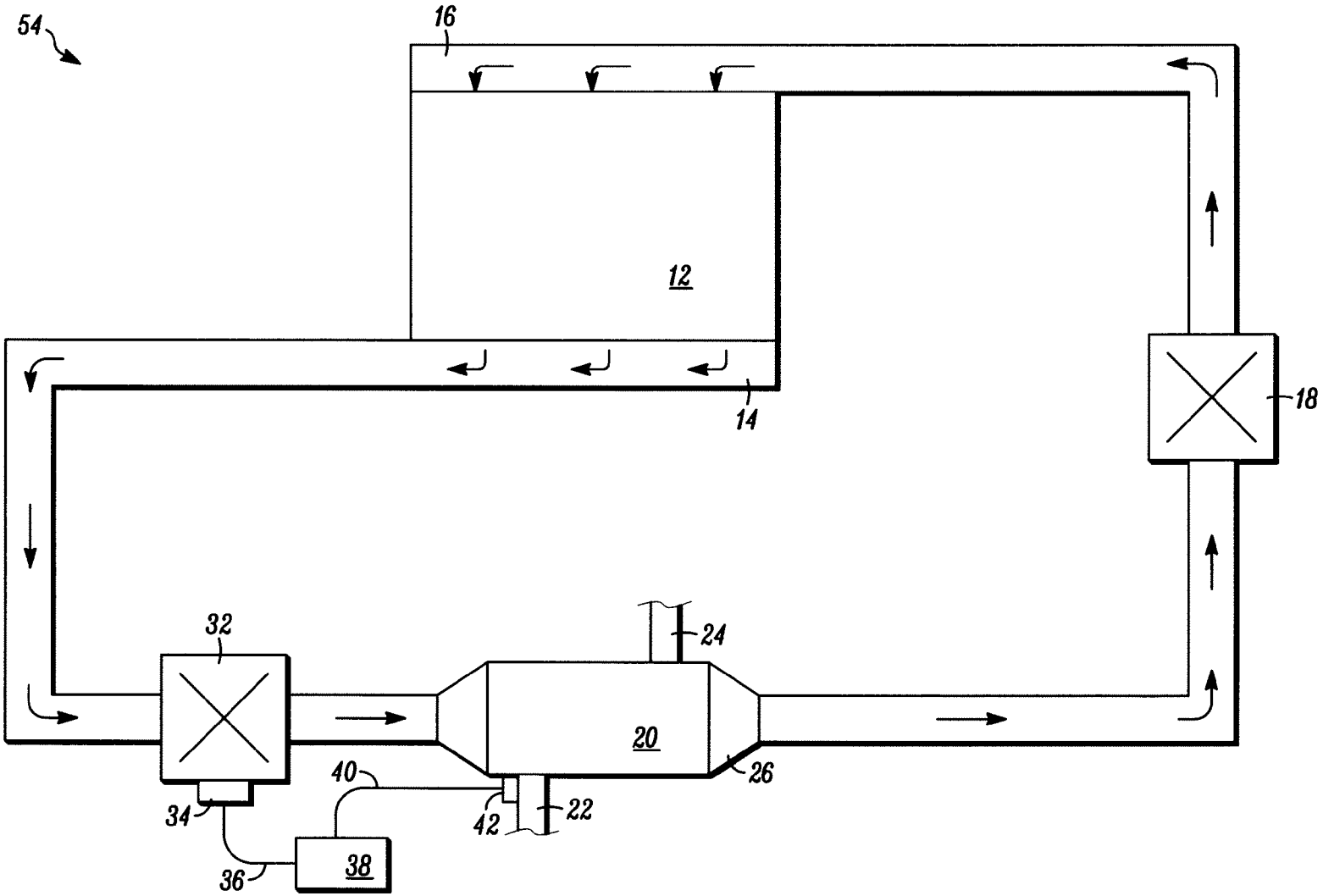
FIG. 4 is a schematic view of a third embodiment cooling system of this invention as used in an EGR system.

FIG. 4. illustrates a third embodiment of the cooling system 54 of this invention that is somewhat similar to that of the first cooler embodiment, except for the fact that the EGR valve 18 is positioned downstream from the cooler 20. Again, as with the embodiments disclosed earlier, the bypass valve 32 is positioned within the exhaust gas stream upstream from the cooler 20 and can be separate or configured as part of the cooler depending on the particular end-use application.

While the cooling system of this invention has been described as using a bypass valve for purpose of reducing the thermal load to the cooler, thereby allowing the cooling medium to reduce its temperature to below its bubble point, cooling systems of this invention can also be used in association with and/or integrated with an ECU or engine control module. In such an embodiment, the ECU can be configured to receive an input signal that monitors the condition of the cooling medium, and send an output signal to reduce the engine load when the input signal signifies that the cooling medium is at or close to its bubble point, thus reducing both the temperature and gas flow of the exhaust gas being directed to the cooler. In such an embodiment, such ECU interaction can be used alone or in conjunction with the bypass valve described above.

Further, the control system of this invention may be configured to work with the ECU, or be integrated into the ECU, to receive the input signals noted above relating to the condition of the cooling medium, and to adjust other parameter such as engine timing, fuel mapping and the like during operating of the bypass valve to avoid violating any emission requirements and/or to maximize operation of the engine during this period of time. Once the desired cooling medium condition is achieved, the control system and ECU can be operated to again make any necessary adjustments to those parameter noted above to ensure both emissions compliance and maximum engine performance.

Figure 5:
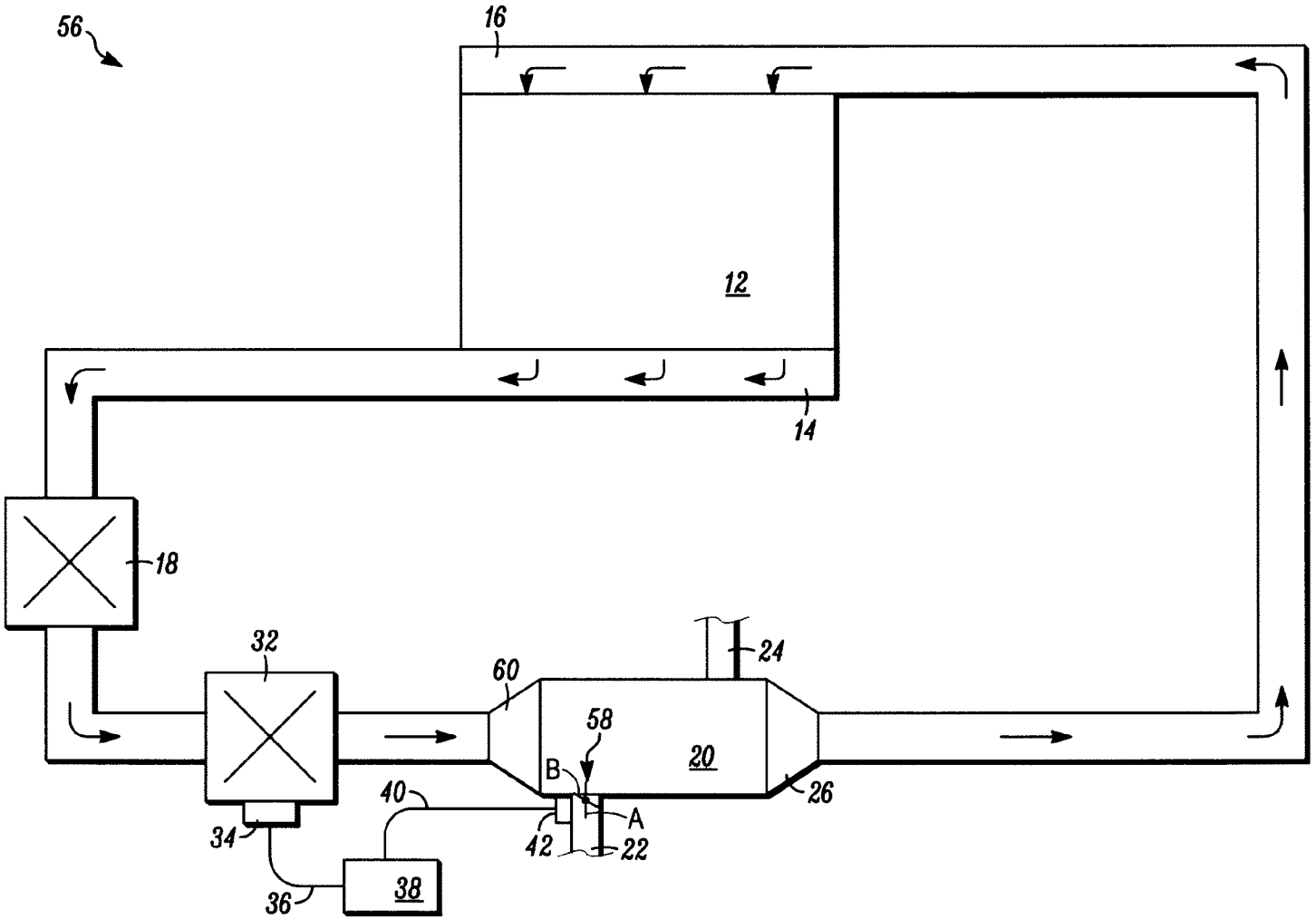
FIG. 5 is a schematic view of a fourth embodiment cooling system of this invention as used in an EGR system.

FIG. 5 illustrates a fourth embodiment of the cooling system 56 of this invention. In this particular embodiment, the cooler 20 has been specially designed to include one or more movable vanes 58, flaps, baffles or the like that is disposed within the cooler. The movable vane 58 is preferably positioned at a location within the cooler inlet that will enable the flow of cooling medium into the cooler to be deflected to an area within the cooler that is likely to experience the highest heat load during operation. In an example embodiment, the movable vane 58 is positioned within the cooler within the cooling medium inlet 22 and is configured to direct the cooling medium in one direction when the cooler is operating in a normal mode, i.e., when the cooling medium is not in a boiling state or mode, and to direct the cooling medium in another direction when the cooler is operating in a nonnormal mode, i.e., when the cooling medium is detected as being in a boiling state or mode. Alternatively, the vane can be disposed within the cooler downstream from the cooling medium inlet.

As illustrated in FIG. 5, in this particular embodiment, the movable vane 58 is placed in position "A" to be approximately perpendicular with the flow of exhaust gas through the cooler when the cooler is in the normal mode of operation, thereby directing the flow of cooling medium within the cooler towards the plurality of exhaust gas passages within the cooler. The movable vane 58 is placed in position "B" that is at an angle relative to the direction of the incoming cooling medium calculated to direct the cooling medium toward a hot-side inlet header 60 of the cooler. In this particular embodiment, the movable vane 58 is placed at an angle of approximately 45 degrees relative to the direction of the entering cooling medium. Although particular placement positions for the movable vane 58 have been illustrated and described, it is to be understood that these are only representative of a preferred embodiment, and that other placement positions can exist depending on such factors as the configuration of the different cooler elements and the like.

The movable vane 58 is operated by an actuator (not shown) that is configured to move the vane from position "A" to position "B" based on a control signal provided by a controller, such as the controller noted above for the earlier discussed embodiments of the invention. It is to be understood that cooling system embodiments of this invention may comprise such cooler with the movable vane in addition to the bypass valve to achieve the desired regulation of cooling medium condition or can make use of only the cooler with the movable vane, e.g., without the use of a bypass valve, to achieve the desired regulation of cooling medium condition, depending on the particular end-use application.

Figure 6:
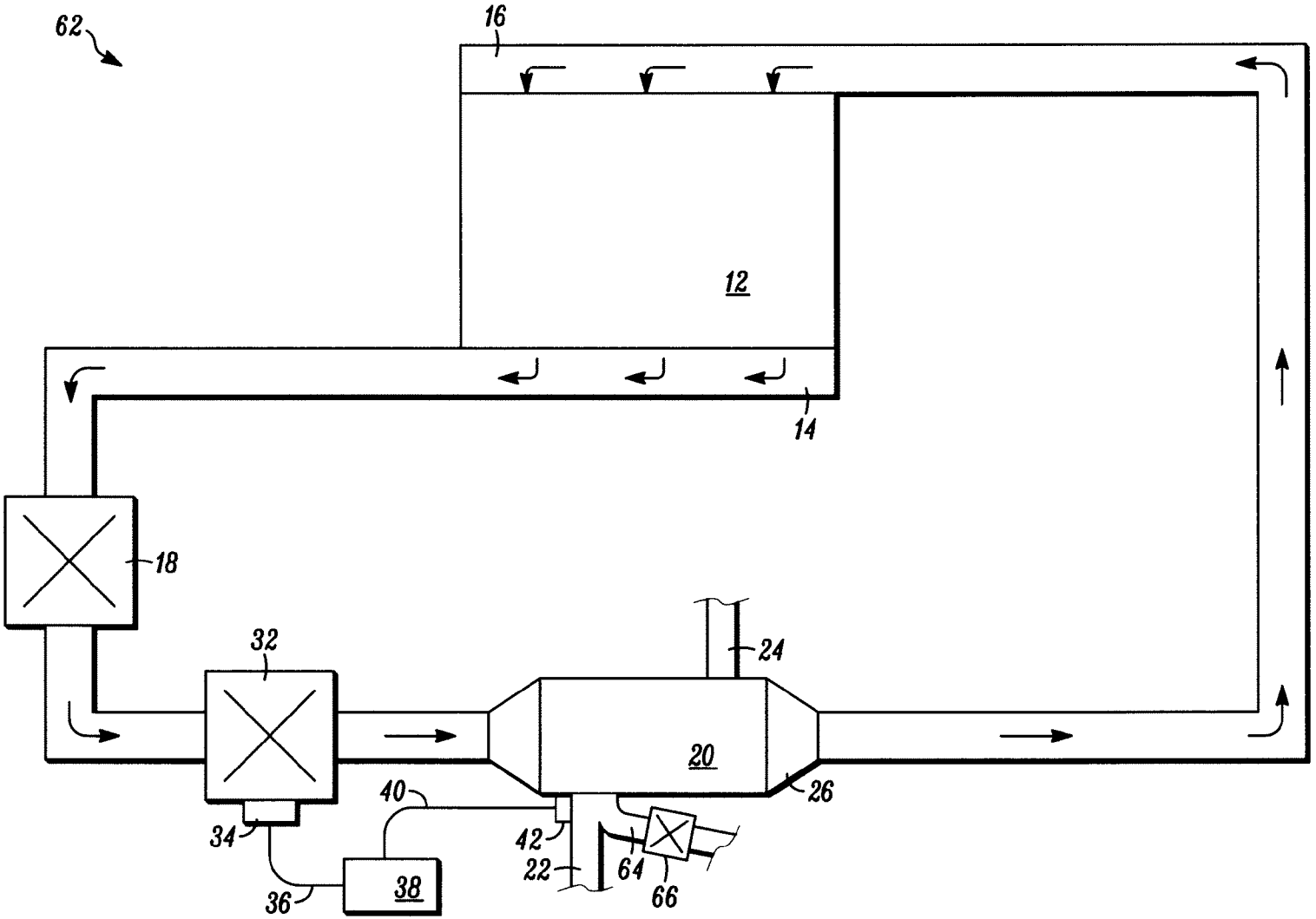
FIG. 6 is a schematic view of a fifth embodiment cooling system of this invention as used in an EGR system.

FIG. 6 illustrates a fifth embodiment of the cooling system 62 of this invention. In this particular embodiment, the cooler 20 has been specially designed to include an auxiliary cooling medium inlet 64 that is configured to introduce an additional volume of cooling medium into the cooler to combine with the cooling medium already being passed into the cooler via inlet 22. A valve 66 or the like can be used to control the passage of additional cooling medium into the cooler via the auxiliary inlet 64 in those instances when the cooling medium is observed to be at in a boiling state or mode.

The valve 66 can be operated by an actuator (not shown) that is configured to permit the passage of the additional cooling medium into the cooler via the auxiliary inlet 64 in response to a control signal provided by a controller as noted in the example embodiments disclosed above. Thus, when the cooling medium within the cooler is determined to be at its boiling point, the controller sends a control signal to open the valve 66 to introduce an additional volume of cooling medium into the cooler to combine with the existing cooling medium and thereby reduce the overall cooling medium temperature to below the boiling point.

It is to be understood that cooling system embodiments of this invention may comprise such cooler with the auxiliary cooling medium inlet in addition to the bypass valve to achieve the desired regulation of cooling medium condition or can make use of only the cooler with the auxiliary cooling medium, e.g., without the use of a bypass valve, to achieve the desired regulation of cooling medium condition, depending on the particular end-use application.

A feature of the cooling systems of this invention is that they are configured to control the condition of the cooling medium within a cooler to avoid unwanted boiling that adversely impacts the performance of the cooler, and that can result in unwanted damage to the cooler, thereby operating to improve/optimize cooling system performance and extend cooling system service life.

While cooling systems of this invention have been described and illustrated as being useful in the context of EGR systems, it is to be understood that cooling systems of this invention can be used in a variety of other applications where the control of cooling medium conditions, e.g., to minimize and/or eliminating cooling medium boiling within a cooler, is desired for the purpose of improving cooling system performance and/or extending cooling system life. For example, the cooling system of this invention can be used with turbocharged engine systems for the purpose of cooling the pressurized charge air exiting the turbocharger before being introduced into the engine for combustion.

Having now described the invention in detail as required by the patent statutes, those skilled in the art will recognize modifications and substitutions to the specific embodiments disclosed herein. Such modifications are within the scope and intent of the present invention.

What is claimed is:

1. A cooling system comprising:

a cooler including a hot-side inlet, a hot-side outlet, and one or more hot-side passages extending between the hot-side inlet and the hot-side outlet, the cooler further comprising a cold-side inlet and a cold-side outlet and one or more cooling passages extending between the cold-side inlet and cold-side outlet, wherein a cooling medium is disposed within the one or more cooling passages and is in contact with the hot-side passage to reduce the temperature of hot gas or liquid passing through the one or more hot-side passages; and means for regulating the condition of the cooling medium within the cooler to reduce the occurrence of the cooling medium being in a transitional boiling state, wherein the means includes a controller that provides an output signal in response to a detected condition of the cooling medium, said detected condition being the transition boiling state of said cooling medium, and a device that receives the output signal and changes the operation of the cooling system in response to said detected condition to reduce the occurrence of cooling medium boiling within the cooler at the transitional boiling state and to increase the occurrence of cooling medium boiling within the cooler at a nucleate boiling mode, said change in the operation of the cooling system being selected from the group consisting of adjusting an amount of the hot gas or liquid directed to the hot-side passages of the cooler, changing flow direction of cooling medium within the cooling passages of the cooler from a direction toward a portion of said hot-side passages between said hot-side inlet and said hot-side outlet within the cooler to a direction toward said hot-side inlet, supplying an additional volume of cooling medium to enter and mix with the cooling medium already disposed in the cooler, and combinations thereof.

2. The cooling system as recited in claim 1 wherein the means for regulating comprises a bypass valve that is positioned upstream of the cooler and that is operated by the controller to adjust the amount of gas or liquid directed to the hot-side of the cooler.

3. The cooling system as recited in claim 1 wherein the means for regulating comprises a vane that is movably disposed within the cooler and that is positioned to change the flow direction of cooling medium within the cooler from a direction toward a portion of said hot-side passages between said hot-side inlet and said hot-side outlet within the cooler to a direction toward said hot-side inlet.

4. The cooling system as recited in claim 1 wherein the means for regulating comprises an auxiliary cold-side inlet positioned on the cooler to cause an additional volume of cooling medium to enter and mix with the cooling medium already disposed in the cooler.

5. The cooling system as recited in claim 4 further comprising a valve connected with the auxiliary cold-side inlet that controls the passage of additional cooling medium into the cooler.

6. The cooling system as recited in claim 1 wherein the cooling system is used with an internal combustion engine, and the device adjusts one or more operating modes of the engine to meet emission requirements, maximize operation of the engine, or both.

7. The cooling system as recited in claim 1 wherein the cooling system is used with an internal combustion engine exhaust gas recirculation system, and the hot-side gas or liquid is exhaust exiting the engine.

8. The cooling system as recited in claim 1 wherein the cooling system is used with a turbocharged engine system, and the hot-side gas or liquid is pressurized air exiting a turbocharger for introduction into the engine.

9. The cooling system as recited in claim 1 comprising a pressure sensor that detects the condition of the cooling medium and that provides an input signal to the controller, wherein the controller is designed to determine whether the pressure corresponds with the cooling medium being in a transitional boiling state.

10. A cooling system for use with an internal combustion engine comprising:

a heat exchanger comprising a hot-side inlet, a hot-side outlet, and one or more hot-side passages extending therebetween, wherein the hot-side inlet is in gas flow communication with an exhaust gas stream exiting the engine, the heat exchanger further comprising a cold-side inlet and a cold side outlet, wherein the cold side inlet is in fluid flow communication with a source of cooling medium, wherein the cooling medium passes into the heat exchanger and makes contact with the hot-side passages as the cooling medium is passed from the cold-side inlet to the cold-side outlet through at least one cold-side passage;

an exhaust gas bypass valve that is positioned adjacent the heat exchanger hot side inlet and is controlled by an actuator to regulate the flow of exhaust gas to the heat exchanger;

a means for sensing the condition of the cooling medium within the heat exchanger; and a controller for receiving input from the means for sensing and determining whether the cooling medium is in a boiling state by comparing a stored value within said controller with said received input from said means for sensing and for controlling the actuator operating the bypass valve to adjust the amount of exhaust gas directed to the hot-side passages of the heat exchanger based upon said determination of the boiling state of the cooling medium so that the cooling medium within the heat exchanger is not in a boiling state, said bypass valve increasing the amount of bypass of the exhaust gas stream exiting the engine around the hot-side passages upon determining a boiling state of the cooling medium in said at least one cold-side passage by a set amount and duration sufficient to remove the cooling medium from the boiling state.

11. The cooling system as recited in claim 10 wherein the controller comprises an engine control unit for the engine suitable for controlling engine timing, fuel mapping, or both to meet emission requirements and maximize operation of the engine.

12. The cooling system as recited in claim 10 wherein the controller operates the bypass valve to reduce the flow of exhaust gas to the heat exchanger in response to sensing the cooling medium within the heat exchanger in a boiling state.

13. The cooling system as recited in claim 10 further comprising a vane that is movably disposed within the heat exchanger therein and that is positioned to change the flow path of the cooling medium based on the sensed condition of the cooling medium from a direction substantially perpendicular to the direction of flow of said exhaust gas stream in said cooler to a direction angled with the direction of flow of said exhaust gas stream in said cooler.

14. The cooling system as recited in claim 10 further comprising an auxiliary cold-side inlet in the heat exchanger that is in fluid flow communication with an additional cooling medium, the auxiliary cold-side inlet being positioned to direct the additional cooling medium to combine with the cooling medium already disposed within the heat exchanger.

15. The cooling system as recited in claim 14 further comprising a valve that is connected with the auxiliary cold-side inlet to control the flow of additional cooling medium into the heat exchanger.

16. A method for controlling the condition of a cooling medium disposed within a cooler used with an internal combustion engine, the cooler comprising a hot-side inlet and hot-side outlet with one or more hot-side passages extending therebetween, and a cold-side inlet and cold-side outlet for accommodating the passage of the cooling medium within the cooler along a surface of the hot-side passages to reduce the temperature of a hot-side gas or liquid as it passes through the cooler, the method comprising the steps of:

sensing the condition of the cooler with at least one of a cooling medium temperature sensor, cooling medium pressure sensor, or hot-side outlet temperature sensor;

evaluating the condition of the cooling medium to determine whether it is in an undesired boiling state, said evaluating being selected from the group consisting of comparing a sensed temperature of the cooling medium with a boiling temperature of the cooling medium, comparing a sensed pressure of the cooling medium with a vapor pressure of the cooling medium in the cooler, monitoring an increase in a sensed temperature of the hot-side outlet, monitoring sensed cooling medium temperature as a function of sensed cooling medium pressure and determining if a saturation temperature of the cooling medium has been reached and combinations thereof; and adjusting one or more of the amount of hot-side gas or liquid entering the cooler decreasing the amount of hot-side gas or liquid flowing through the hot-side passages, the amount of cooling medium entering the cooler with a valve controlling the introduction of additional cooling medium about an outer surface of the hot-side passages, the flow direction of the cooling medium within the cooler toward the hot-side inlet, and one or more operating conditions of the engine based upon said evaluated condition of said cooling medium to ensure that the condition of the cooling medium is not in the undesired boiling state.

17. The method as recited in claim 16 wherein the step of evaluating comprises sensing the pressure of the cooling medium.

18. The method as recited in claim 16 wherein the step of adjusting comprises operating a bypass valve that is positioned within the flow path of the hot-side gas or liquid entering the cooler to reduce the extent or duration of the flow of the hot-side gas or liquid entering the cooler by a predetermined amount if the condition of the cooling medium within the cooler is in an undesired boiling state.

19. The method as recited in claim 16 wherein the step of evaluating is performed by a controller that receives an input signal from a at least one sensor and that provides an output signal to perform the adjusting step.

* * * * *